US007716759B2

(12) United States Patent
Wilder

(10) Patent No.: US 7,716,759 B2
(45) Date of Patent: May 18, 2010

(54) PATIENT TRANSPORT APPARATUS

(76) Inventor: William A. Wilder, 6088 Hwy. 31, Thorn Hill, TN (US) 37881

( * ) Notice: Subject to any disclaimer, the term of this patent is extended or adjusted under 35 U.S.C. 154(b) by 85 days.

(21) Appl. No.: 11/236,916

(22) Filed: Sep. 28, 2005

(65) Prior Publication Data

US 2007/0067905 A1 Mar. 29, 2007

(51) Int. Cl.
*A61G 7/10* (2006.01)

(52) U.S. Cl. ..... 5/83.1; 5/86.1; 280/47.41; 297/344.2

(58) Field of Classification Search ..... 297/353, 297/376, 411.32, 411.2, 411.34, 411.38, 297/344.12, 344.14, 344.19, 383; 280/250.1, 280/304.1, 47.41, 47.4, 47.38, 43.11, 43.14, 280/43.24; 248/564; 5/81.1 R, 83.1, 86.1, 5/81.1 RP, 81.1 HS See application file for complete search history.

(56) References Cited

U.S. PATENT DOCUMENTS 4,118,069 A * 10/1978 Hunter ..... 297/411.29
4,477,117 A * 10/1984 Higgs ..... 297/45
5,379,468 A 1/1995 Cassidy et al.
5,380,034 A * 1/1995 Wilson ..... 280/657
5,810,104 A 9/1998 Campbell
6,352,307 B1 * 3/2002 Engman ..... 297/284.11
6,361,114 B1 * 3/2002 Rumler ..... 297/411.39
6,430,761 B1 * 8/2002 Brandorff et al. ..... 5/86.1
6,471,297 B1 * 10/2002 Runde et al. ..... 297/411.32
6,651,280 B2 * 11/2003 Blevins ..... 5/611
6,783,179 B2 * 8/2004 Komura et al. ..... 297/344.12
6,877,812 B2 * 4/2005 Congleton et al. ..... 297/353
6,976,698 B2 * 12/2005 Kuiken ..... 280/647
7,222,868 B2 * 5/2007 Norman et al. ..... 280/250.1
7,273,255 B2 * 9/2007 Nylander et al. ..... 297/338
7,611,203 B1 * 11/2009 Roberts et al. ..... 297/344.2
2003/0011228 A1 * 1/2003 Komura et al. ..... 297/344.12
2003/0205883 A1 * 11/2003 Bergstrom et al. ..... 280/304.1
2005/0039256 A1 * 2/2005 Price et al. ..... 5/86.1
2006/0145525 A1 * 7/2006 Syrowik et al. ..... 297/411.32

* cited by examiner

*Primary Examiner*—Victor Batson
*Assistant Examiner*—Emily M Morgan
(74) *Attorney, Agent, or Firm*—Pitts & Brittian, P.C.

(57) ABSTRACT

A patient transport apparatus. The patient transport apparatus of the present invention is articulated and sized to fit between the body and the open door of virtually all vehicles. Further, the patient transport apparatus uses a height-adjustable seat that is aligned with the vehicle seat to allow for simplified extraction of the patient from the vehicle. The height-adjustable seat lowers to just above ground height making the recovery of a fallen patient easier. A set of casters allows omni-directional travel of the patient transport apparatus for precise placement and a pair of primary motion wheels makes linear travel easier while providing a turning radius substantially approaching zero.

17 Claims, 14 Drawing Sheets

PATIENT TRANSPORT APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

The invention relates to a patient transport apparatus.

2. Description of the Related Art

Over the last thirteen years, healthcare providers have witnessed marked change in patient numbers as well as patient needs. Thirteen years ago, a patient weighing 400 pounds or more was a rarity. These patients were extraordinary cases and not an everyday assignment. Today, dealing with patients weighing 400 pounds or more is a daily way of life. At any given time, any healthcare facility is likely to have admitted at least one patient who weighs 600 pounds or more. Although healthcare providers work to provide services to heavier patients by purchasing new equipment and educating staff members; however, the reality remains that it has become increasingly difficult to simply convey patients.

While healthcare providers and healthcare equipment vendors have attempted to address this growing challenge, the currently available solutions appear insufficient when looking at the growing number of staff injuries and lost work time that is associated with conveying patients. Moving heavier patients is one significant contributor to work related injuries. A staff member may be off the schedule for weeks and even months due to such injuries. In addition to the risk to the staff members, there are concerns on the patient side as well.

A patient expects a healthcare provider to meet the patient's healthcare needs. This expectation is independent of the patient's weight. When a patient weighing 150 pounds falls down, it is expected that the healthcare provider will help them up. That same expectation is held by a patient weighing 600 pounds or more. Like the staff member, the patient also runs a risk of injury during transport as a result of being lifted, pulled, pushed, slid from, or transferred into, out of, or between conveyances. While dealing with the very real, difficult, and unfortunate problem of transporting heavier patients, the patient's dignity is often compromised. It is difficult for patients to maintain dignity when ten men are called to move them. It is not uncommon for patients apologize for being so large and so much trouble. One's dignity should not be overlooked, regardless of the weight of the patient.

One of the most problematic areas in patient transport is the loading and unloading of a patient from a vehicle. Patients arriving at a healthcare facility are often transferred from an automobile to a wheelchair so that they may be conveyed to the Emergency Department. The staff member faced with assisting a patient who weighs many times more than the staff member, and who can offer little or no help in exiting the vehicle, gains a completely new appreciation for the many phases of patient conveyance. The confines of the automobile, the obstruction of the door, and the low seat height make patient assistance a difficult task. Conditions such as these are especially likely to result in embarrassment or injury. For example, it is not uncommon to inadvertently set the patient on the ground during this type of transfer, which at best only diminishes the dignity of the patient, and embarrasses the staff member. With luck, no one is injured during this process.

BRIEF SUMMARY OF THE INVENTION

A patient transport apparatus is shown and described. The patient transport apparatus of the present invention is articulated and sized to fit within the door opening of virtually all vehicles. Further, the patient transport apparatus uses a height-adjustable seat that is aligned with the vehicle seat to allow for simplified extraction of the patient from the vehicle. The height-adjustable seat lowers to just above ground height making the recovery of a fallen patient easier. A set of casters allows omni-directional travel of the patient transport apparatus for precise placement and a pair of primary motion wheels makes linear travel easier while providing a minimal turning radius.

The major components of the patient transport apparatus include a frame having a base and a chair support, and a chair having a seat and a back. The base provides stability and a framework for the wheel system. The chair support is substantially orthogonal to the base and carries the chair. The chair is moveable vertically along the substantial height of the chair support. The seat is sized to accommodate a patient of large girth. The backrest is narrower than the seat. The chair is reclined to provide greater comfort for the patient and to position the patient in a manner where gravity assists in holding the patient in the desired position.

The frame is fabricated from a rigid material rated to withstand the applied forces without bending or incurring other damage. The base includes a first side rail and a second side rail. The first side rail and the second side rail are connected by one or more cross-members that are substantially perpendicular to the side rails. One function of the cross-members is to maintain the position of the first side rail relative to the second side rail. The distance between the side rails is selected to provide lateral stability. In addition, the cross-members provide a mounting point for the chair support.

A plurality of free-moving wheels, such as orbital casters, provide the patient transport apparatus with omni-directional movement for precise positioning and control. In addition, a plurality of primary motion wheels are provided for efficiently moving the patient transport apparatus over longer linear distances and for making turns with a substantially zero-degree turn radius.

The chair also includes a pair of articulated armrests generally having three degrees-of-freedom allowing the armrests to surge, sway, and pitch. Once a patient is positioned in the chair, a safety restraint secures the patient in place. A footrest is located proximate to the forward end of the base.

The chair support is a substantially vertical pillar that serves as a guide and support for the vertically-moving chair. The chair support is designed to withstand the frontal torque and the load requirements of the patient transport apparatus. Positioned at the second end of the chair support and distal from the base is a control box. The control box encloses the drive control system. The drive control system actuates the vertical movement of the chair. A simple user interface allows the operator to control the up and down movement of the chair.

The foundation of the chair is the chair frame. The chair frame includes a pair of side brackets that are connected by a plurality of cross members. The side brackets define substantially vertical extensions and substantially horizontal extensions. The substantially horizontal extensions is connected to the carriage, which travels on the chair support, and supports the seat and the substantially vertical extensions carry the backrest.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A patient transport apparatus is described and shown at 100 in the figures. The patient transport apparatus 100 of the present invention is articulated and sized to fit between the body and the open door of virtually all vehicles. Further, the patient transport apparatus 100 uses a height-adjustable seat that is aligned with the vehicle seat to allow for simplified extraction of the patient from the vehicle. The height-adjustable seat lowers to just above ground height making the recovery of a fallen patient easier. A set of casters allows omni-directional travel of the patient transport apparatus 100 for precise placement and a pair of primary motion wheels makes linear travel easier while providing a minimal turning radius.

Figure 1:
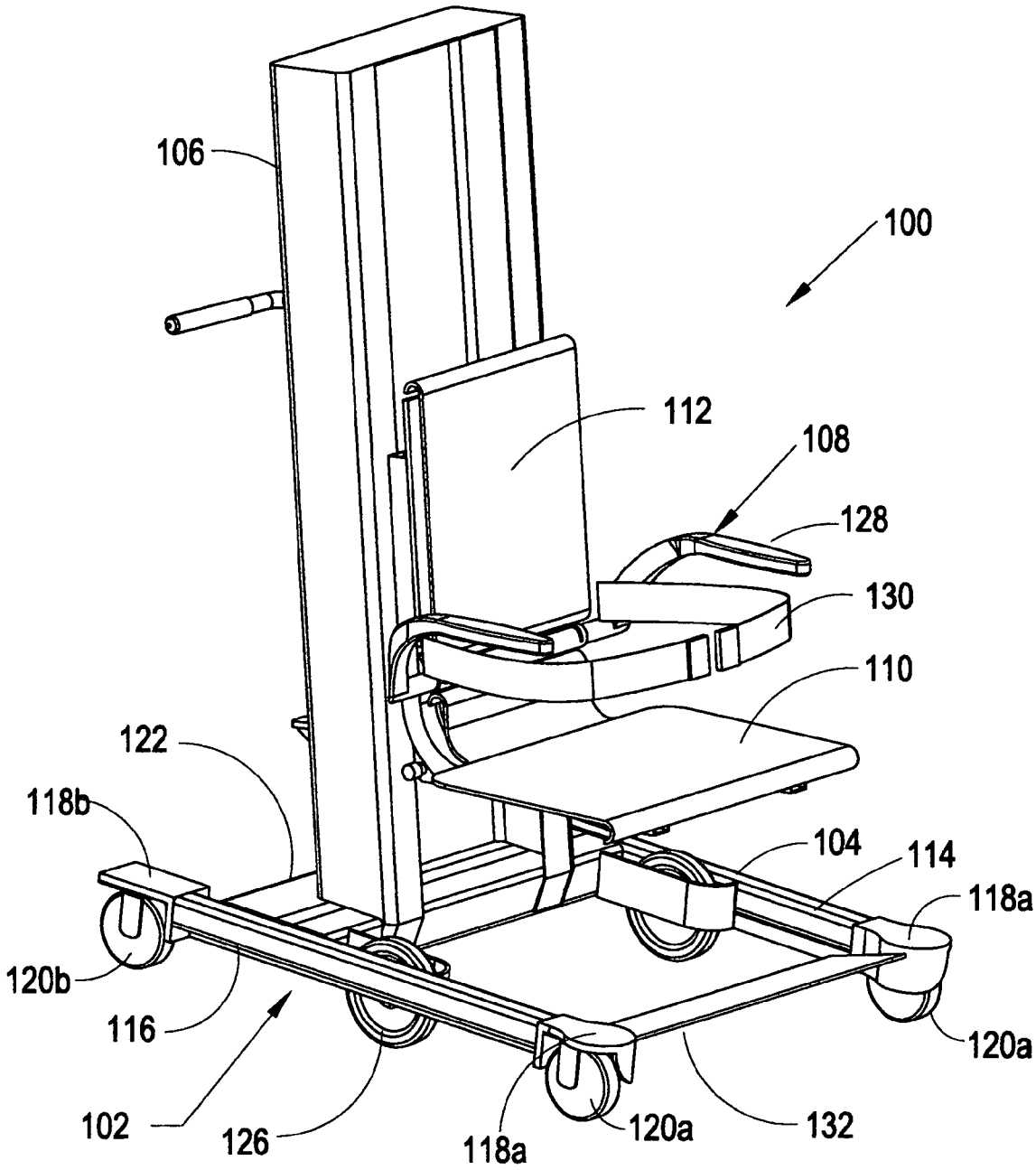
FIG. 1 is a perspective view showing the front of one embodiment of the patient transport apparatus of the present invention having a small-diameter primary motion wheel system and a manual lift system.

FIG. 1 is a front perspective view of the patient transport apparatus 100. The major components of the patient transport apparatus 100 include a frame 102 having a base 104 and a chair support 106, and a chair 108 having a seat 110 and a back 112. The base 104 provides stability and a framework for the wheel system. The chair support 106 is substantially orthogonal to the base 104 and carries the chair 108. The chair 108 is moveable vertically along the substantial height of the chair support 106. The seat 110 is sized to accommodate a patient of large girth. The backrest 112 is narrower than the seat 110.

The frame 102 is fabricated from a rigid material rated to withstand the applied forces without bending or incurring other damage. The base 104 includes a first side rail 114 and a second side rail 116. The first side rail 114 and the second side rail 116 are connected by one or more cross-members 122. In the illustrated embodiment, the base 104 includes a pair of cross-members 122. Each of the cross-members 122 is substantially perpendicular to the side rails 114, 116. One function of the cross-members 122 is to maintain the position of the first side rail 114 relative to the second side rail 116. The distance between the side rails 114, 116 is selected to provide lateral stability. The chair support 106 is positioned substantially midway between the side rails 114, 116 further contributing to the lateral stability of the patient transport apparatus 100. In order to locate the chair support 106 between the side rails 114, 116, the chair support 106 is connected to one or more of the cross-members 122. In the illustrated embodiment, the cross members 122 are located rearward of the midpoints of the side rails 114, 116.

Connected to the base 104, at each end of the side rails 114, 116, are a plurality of wheel support members 118*a*, 118*b*. The wheel support members 118*a*, 118*b* serve as carriers for a plurality of wheels 120*a*, 120*b* that impart mobility to the patient transport apparatus 100. In one embodiment, the wheel support members 118*a*, 118*b* are integrally formed with the side rails. In another embodiment, the wheel support members 118*a*, 118*b* are permanently attached to the side rails 114, 116 through a process such as welding. In yet another embodiment, the wheel support members 118*a*, 118*b* are temporarily attached through releasable fasteners such as bolts.

The patient transport apparatus 100 of the present invention is designed to allow an operator to precisely control the movement of the patient transport apparatus 100 with a wide range of motion. Accordingly, the plurality of wheels 120*a*, 120*b* is selected to allow freedom of movement in substantially all directions. In one basic embodiment, non-locking orbital casters are used. In another embodiment, non-locking orbital casters are attached to the front pair of wheel support members 118*a* and locking orbital casters are used with the rear pair of wheel support members 118*b*. In other embodiments, the wheels used can vary without departing from the scope and spirit of the present invention.

In addition to the aforementioned plurality of wheels 120*a*, 120*b*, the patient transport apparatus 100 includes a pair of side-mounted primary motion wheels 126. The distance between the side-mounted primary motion wheels 126 is sufficient to allow the seat to pass between them and lower all the way to the ground. In the illustrated embodiment, the primary motion wheels 126 are free-rolling. In another embodiment, the primary motion wheels 126 are motorized to provide forward motion assistance.

In one embodiment, the seat 110 is a platform supported by a fixed-end cantilever. The seat 110 includes a major portion that is substantially planar and defines the seating area. In the illustrated embodiment, the seat 110 includes a substantially orthogonal extension that provides a rear stop to prevent the patient from sliding past the rear edge of the seat. The forward edge and rearward edge of the seat are rolled edges for the comfort of the patient and present a substantially snagless surface. In another embodiment, the side edges of the seat are rolled edges.

The seat 110 and the backrest 112 are fabricated from a substantially rigid material with a low coefficient of friction. The rigidity that is selected to support the target load capacity of the chair. The material used in the fabrication of the seat 110 and the backrest 112 is selected to have a substantially low coefficient of friction intended to allow a patient to easily slide along the surface. In one embodiment, the seat and backrest are fabricated from a metal such as stainless steel and finished with a smooth surface.

The chair 108 also includes a pair of articulated armrests 128. In one embodiment, the articulated armrests 128 are constructed with three degrees-of-freedom allowing the armrests to surge, sway, and pitch. First, the articulated armrests 128 are capable of longitudinal translation (surging) allowing forward and backward motion for patient comfort. Second, the articulated armrests 128 are capable of lateral translation (swaying) allowing the armrests to slide left and right to accommodate patients of varying girth. Finally, the articulated armrests 128 are pivotally mounted to the chair 108 allowing them to be rotated from a substantially horizontal position to a substantially vertical position (pitch). When in the substantially vertical position, the articulated armrests 128 are even with or behind the plane defined by the chair back 112 allowing a patient to slide laterally onto the seat 110 unhindered. When in the substantially horizontal position, the articulated armrests provide the patient with positional security. As with other components of the patient transport apparatus, the articulated armrests are fabricated from a material that is substantially rigid and exhibits sufficient structural strength to withstand the anticipated load conditions.

Once a patient is positioned in the chair 108, a safety restraint 130 secures the patient in place. The safety restraint 130 is attached to the rear of the chair back 112 and has a front latch mechanism that is actuated by the patient or an operator. Further the safety restraint 130 is length adjustable to accommodate patients of varying girth.

A footrest 132 is located proximate to the forward end of the base 102. In one embodiment, the rear edge of footrest 132 is pivotally secured to the side rails 114, 116 of the base 104. When not needed, the footrest 132 is moved out of the way by catching underneath the front of the footrest 132 and rotating it up, back, and out of the way. The footrest offers comfort and stability by helping the patient to maintain a seated position while being transported. In another embodiment, the footrest 132 is removably secured to the side rails 114, 116 and can be removed when necessary.

Figure 2:
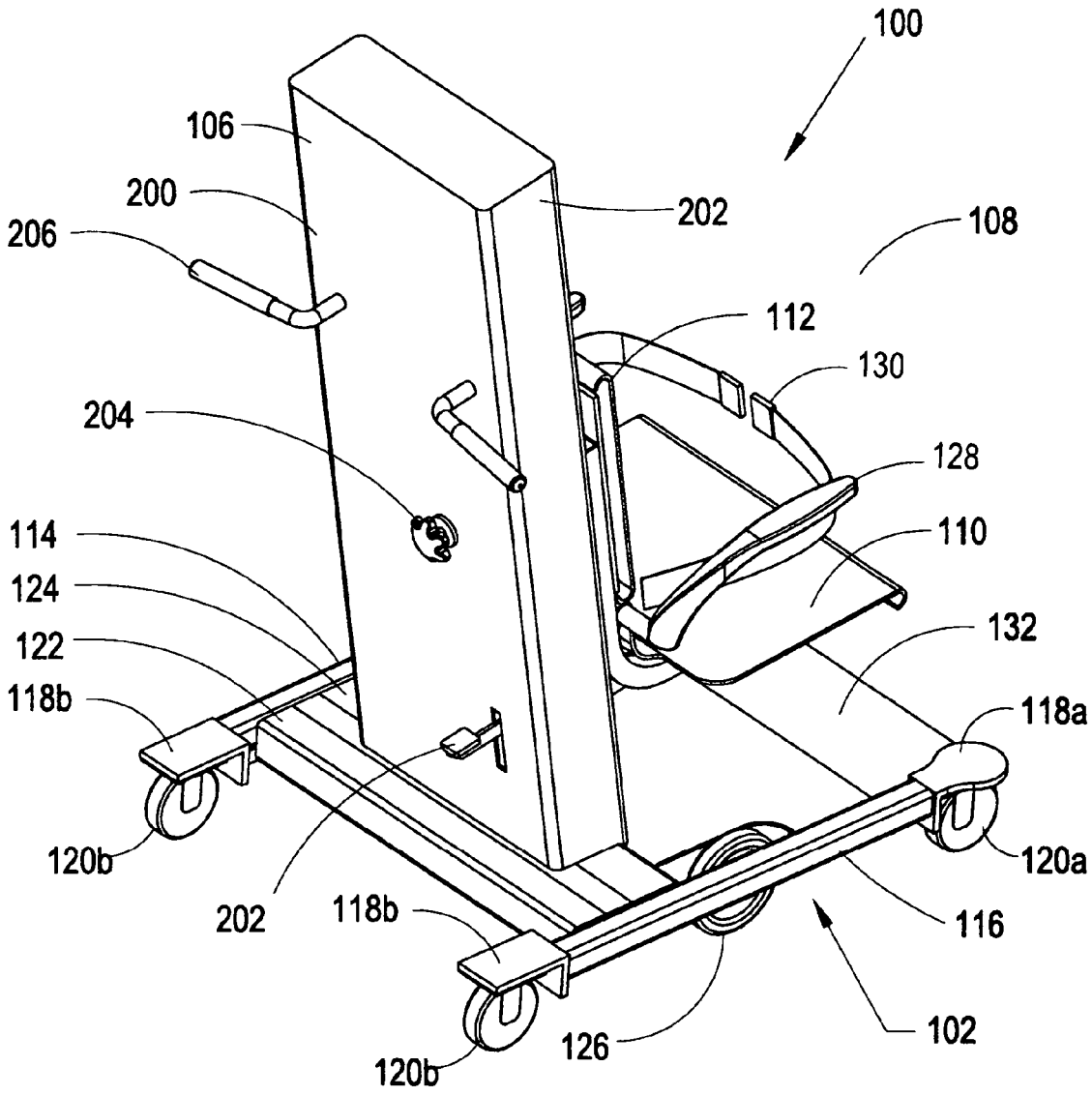
FIG. 2 is a perspective view showing the rear of the patient transport apparatus of FIG. 1.

FIG. 2 illustrates a rear perspective view of the patient transport apparatus 100. From this perspective, the details of the chair support 106 are visible. The chair support 106 is a substantially vertical pillar that serves as a guide and support for the vertically-moving chair 108. The chair support 106 is designed to withstand the frontal torque and the load requirements of the patient transport apparatus 100. In the illustrated embodiment, the chair support 106 includes a housing 200. Within the housing 200 is the lift mechanism that raises and lowers the chair 108. In one embodiment, the lift system uses hydraulic pressure to raise and lower the chair. In a manual embodiment, a foot pedal 202 increases the hydraulic pressure to raise the chair 108 and a relief knob releases the hydraulic pressure lowering the chair 108.

Attached to the chair support 106 are one or more folding control handles 206. The folding control handles 206 are pivotally connected to the chair support 106 allowing the folding control handles 206 to be folded up and out of the way when the patient transport apparatus 100 needs to be brought into close proximity with an object such as an automobile. A substantially rigid material having sufficient strength to allow the patient transport apparatus 100 to be pushed or pulled using the folding control handles 206 without deformation of the folding control handles 206 is used. The opposing side placement of the folding control handles 206, in combination with the plurality of wheels 120*a*, 120*b*, allows an operator to precisely control the movement of the patient transport apparatus 100. The folding control handles 206 are positioned for a person of average height pushing a patient of average height positioned at a comfortable seat to footrest ratio.

Figure 3:
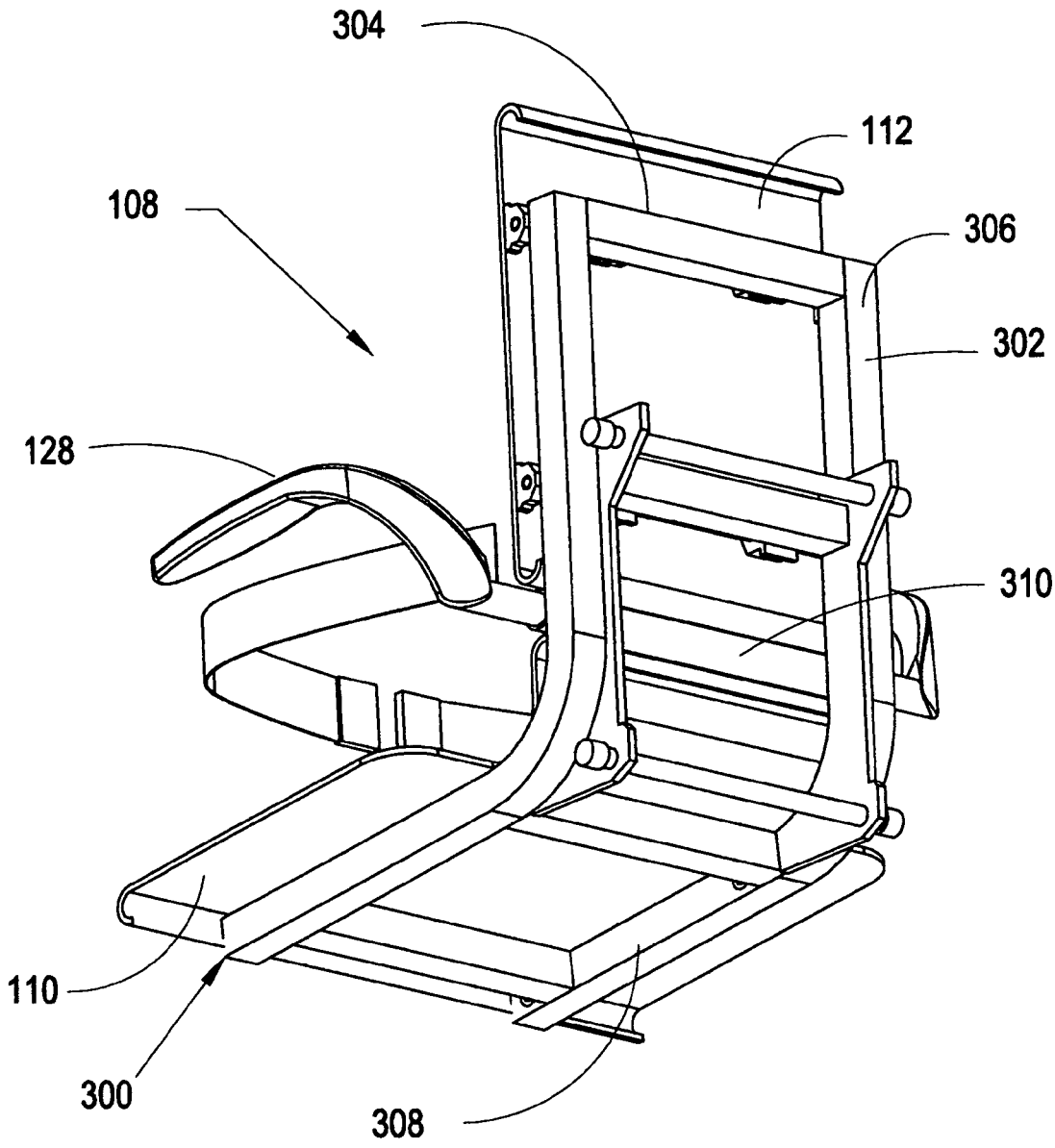
FIG. 3 is a perspective view showing the rear and bottom of one embodiment of the chair.
Figure 4:
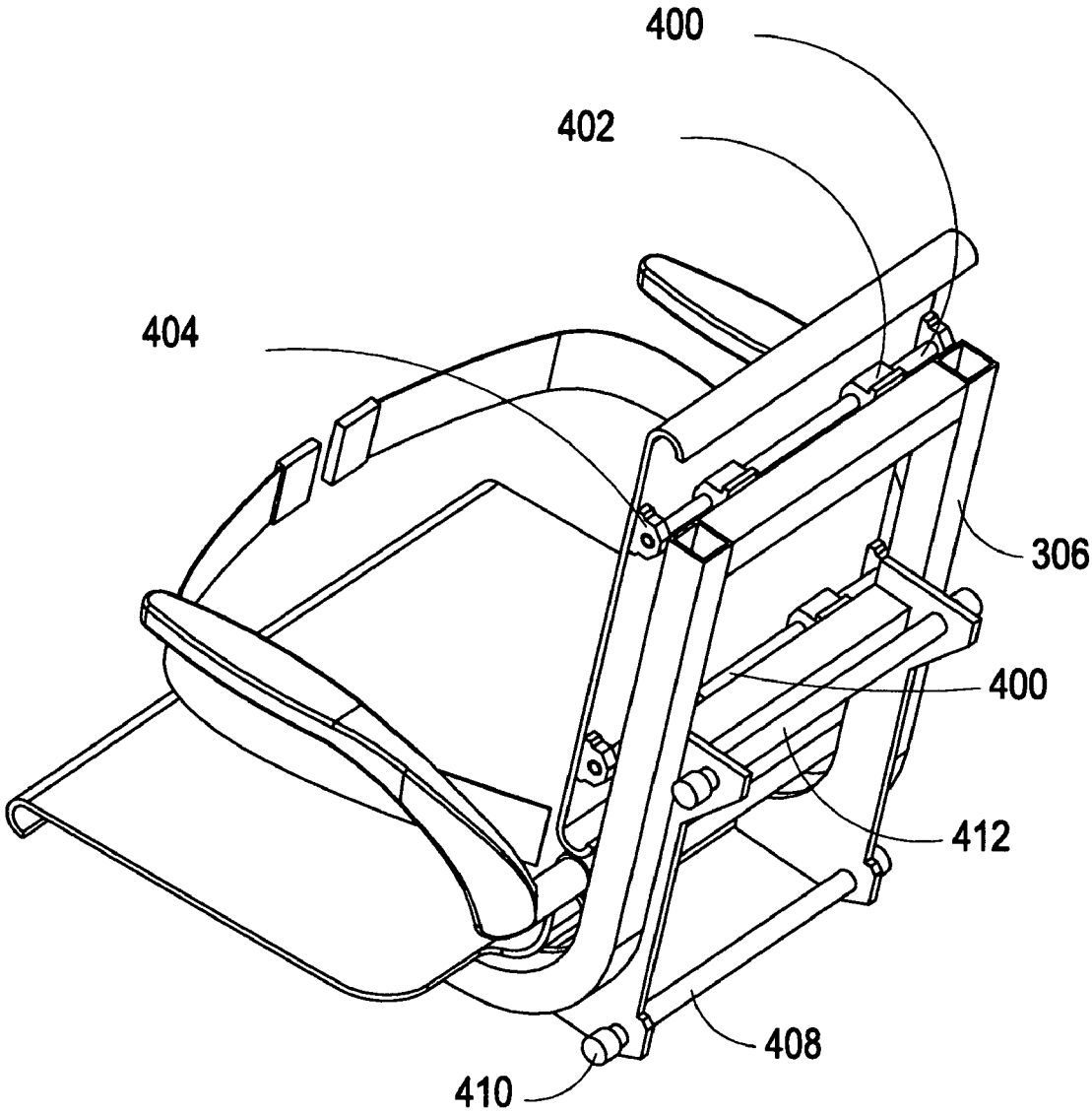
FIG. 4 is a perspective view showing the side and rear of one embodiment of the chair.
Figure 5:
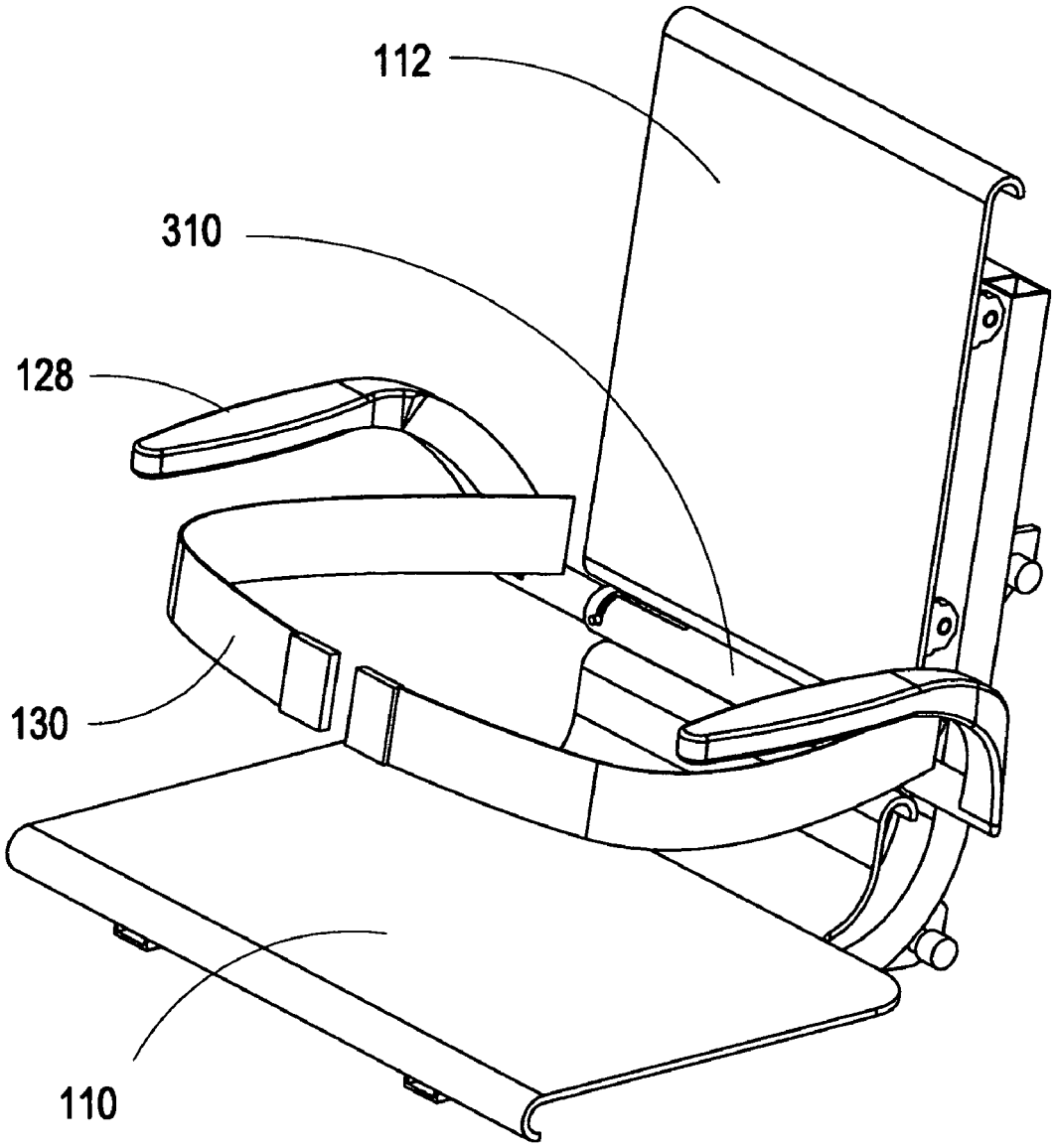
FIG. 5 is a perspective view showing the front of one embodiment of the chair.

FIGS. 3, 4, and 5 are perspective views of one embodiment of the chair 108 of the patient transport apparatus 100 from differing vantage points. FIG. 3 shows the rear and bottom of the chair 108. The foundation of the chair 108 is the chair frame 300. The chair frame 300 includes a pair of side rails 302 that are connected by a plurality of cross members 304. The side rails 302 define substantially vertical extensions 306 and substantially horizontal extensions 308. The substantially horizontal extensions 308 are connected to 218 a bracket used to attach the chair 108 to the lift mechanism and support the seat 110 and the substantially vertical extensions 306 carry the backrest 112.

The chair frame 300 also includes a telescopic carrier 310 for the supporting the articulated armrests 128. The telescopic carrier 310 is securely affixed to the chair frame 300. The telescopic carrier 310 extends axially allowing the lateral position of the articulated armrests 128 to be adjusted as desired. Each end of the telescopic carrier 310. An articulated armrest is pivotally attached to the each end of the telescopic carrier 310. In one embodiment, the end sections of the telescopic carrier 310 are hollow cylindrical members that receive a rotating shaft connected to the armrest. In another embodiment, the articulating armrests are rotatably secured to the outside diameter of the telescopic carrier 310. In one embodiment, the telescopic sections are free sliding and are secured in a locked relationship using a clamp. In another embodiment, notches provide periodic stops that hold the telescopic sections in a locked relationship. In still another embodiment, the telescopic sections are locked in a fixed position by a releasable pin. In yet another embodiment, the outer section of the telescopic carrier 310 includes a longitudinal groove and a series of spaced apart lateral grooves that intersect the longitudinal groove. The inner section of the telescopic carrier 310 has an external key that engages the grooves. When aligned with the longitudinal grove, the inner section slides laterally. When the key engages one of the lateral grooves, the inner section becomes locked in a fixed position.

FIG. 4 shows the rear of the chair 108 from a different perspective. Whereas the seat 110 is secured in a fixed position, the backrest 112 moves laterally. A pair of horizontal linear slide rods 400 passes through openings defined by each of sets of linear bearings 402 connected to the side rails 302. A pair of stop brackets 404 for each of the linear slide rods 400 is located on the backrest 112 proximate to the side edges. The stop brackets 404 are attached proximate to ends of the linear slide rods 400. The backrest 112 moves laterally as the slide rods 400 pass through the linear bearings 402. The stop brackets 404 limit the travel of the backrest 112. The lateral movement of the backrest 112 allows the patient transport apparatus 100 to be brought into close proximity of a vehicle. More specifically, the lateral movement allows the seat 110 to be moved unobstructed beyond the door post of a vehicle to position the patient transport apparatus 100 for patient extraction. In addition providing lateral movement, the stop brackets 404 and the linear bearings 402 support the backrest 112 at a distance from the substantially vertical extensions 306 allowing the articulated armrests 128 to be positioned behind the plane of the backrest 112 when the articulated armrests 128 are moved to a substantially vertical position.

The side rails 302 carry at least one tram axle 408 that supports a pair of tram rollers 410. In the illustrated embodiment, two tram axles 408 are shown with one located proximate the midpoint and the other proximate to the lower end of the substantially vertical extensions 306. The tram rollers 410 are secured on the tram axle 408 in a spaced-apart relationship and each tram roller 410 is aligned with one of the vertical tram rails 200, 202. As the chair 108 is moved up and down the chair support 106, the tram rollers 410 provide additional support for the chair 108. In one embodiment, the tram rollers 410 utilize roller or needle bearings for smooth operation and long life. A pivot axle 412 connects the chair frame 300 to a carriage that moves vertically in response to the lift system. The pivot axle 412 is designed to allow the chair to pivot relative to the chair support 106. This subtle pivotal action is necessary in that the seat while remaining on a recline position on the vertical tram rails will rest flat on the floor when at the bottom of the vertical tram rails the tram guide rollers pass over the 90° angle of the tram. This allows the seat to rest flat on the floor for recovering fallen patients.

FIG. 5 shows the chair 108 from the front providing an alternate view of the features described in relation to FIGS. 3 and 4. The patient transport apparatus 100 has a reclined chair 108 in contrast to the traditional right angle seat found in the prior art. The reclined chair 108 provides greater comfort for the patient and positions the patient in a manner where gravity assists in holding the patient in the desired position. With traditional wheelchairs, it is not uncommon for an unconscious or a semi-conscious patient to slide down and out of the wheelchair and onto the floor. By reclining the chair 108 and raising the patient's knees equal to or above their beltline, it is possible for a totally relaxed person not to slide down and out of a seated position. The position of the patient's knees is adjusted by raising or lowering the chair 108 to achieve the desired seat-to-footrest height ratio. Further, the reclined chair does not interfere with the ability of an ambulatory patient to stand up and exit from the patient transport apparatus 100 unassisted.

Figure 6:
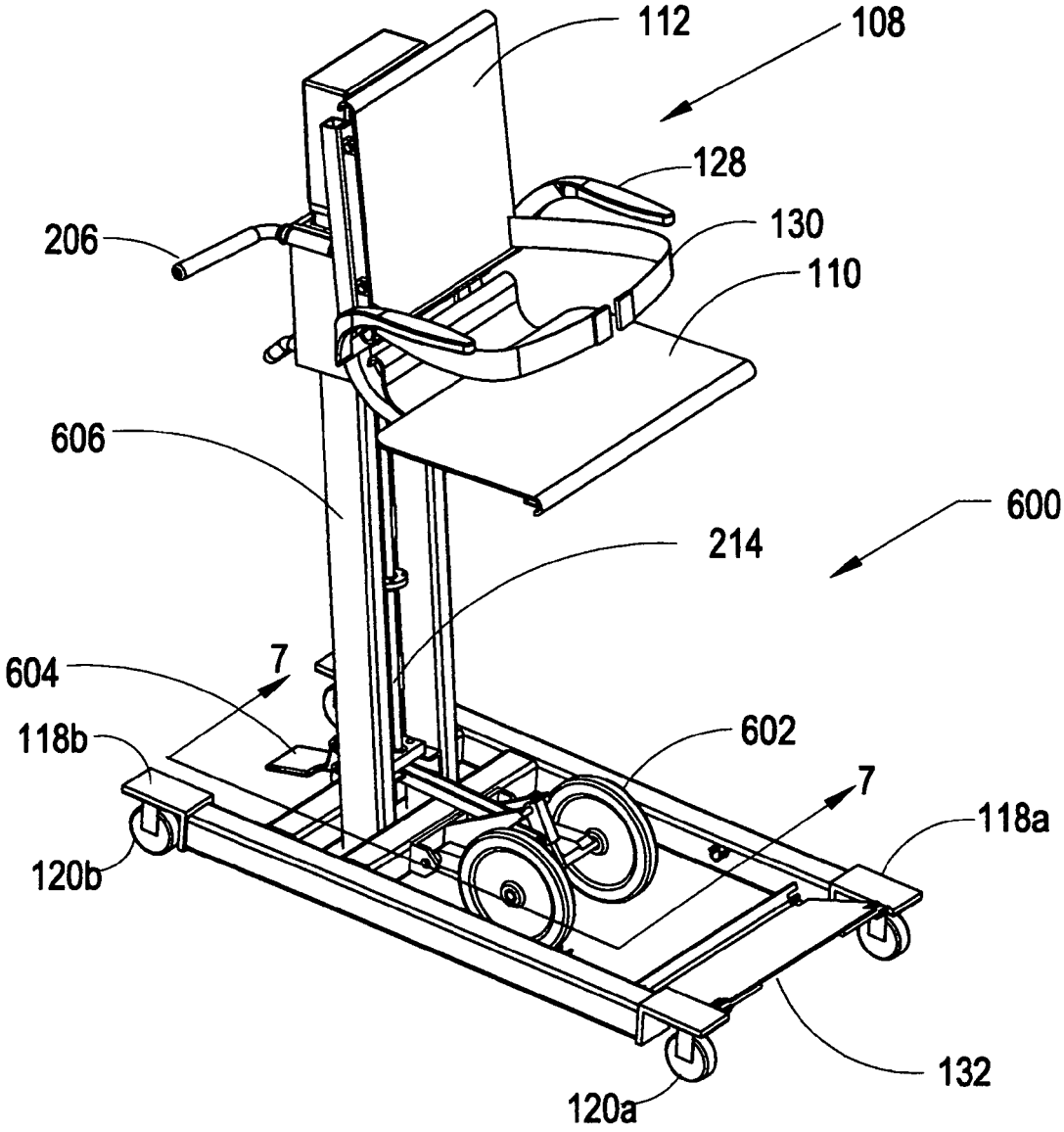
FIG. 6 is a perspective view showing the front of an alternate embodiment of the patient transport apparatus having a center-mounted primary motion wheel system and electronic lift system.

FIG. 6 illustrates an alternate embodiment of the patient transport apparatus 600 that replaces the side-mounted primary motion wheels with a center-mounted primary motion wheel system 602. In this instance, large diameter generally refers to a diameter that is larger than the diameter of the casters used. Actuating a foot peddle 604 deploys the center-mounted primary motion wheel system 602 and transfers a percentage of the load borne by the patient transport apparatus 600 off of the plurality of corner wheels 120*a*, 120*b*. Use of the center-mounted primary motion wheel system 602 makes the patient transport apparatus 600 easier to roll while retaining steering and control.

Figure 7:
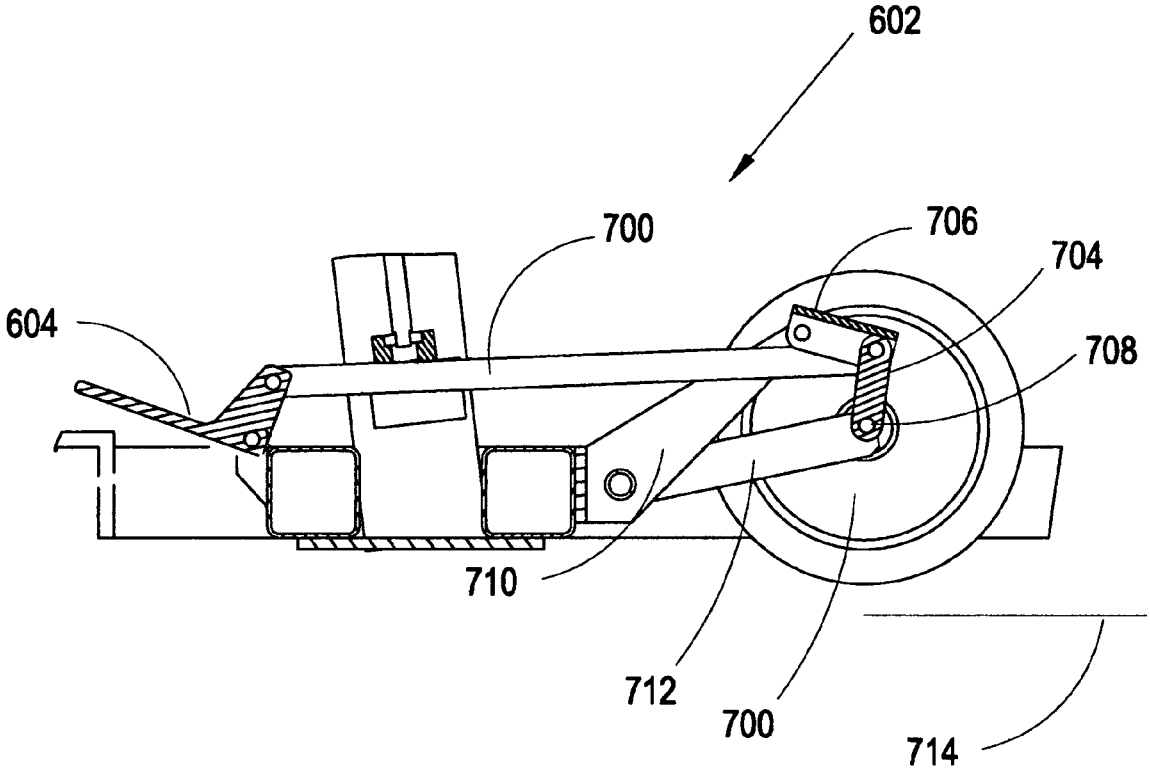
FIG. 7 is a sectional side elevation view of the center-mounted primary motion wheel system in a retracted position.

FIG. 7 is a side elevation of the patient transport apparatus 600 showing the center-mounted primary motion wheel system 602 in a retracted position. Through the use of foot pedal controlled levers, the engagement of the center-mounted wheels is controlled. In the illustrated embodiment, the foot pedal 604 is substantially L-shaped with the corner of the foot pedal 604 pivotally connected to the frame 102 and, more specifically, pivotally connected to one of the cross members 122, 124. Pivotally connected to one end of the foot pedal 604 is a lever arm 702. The lever arm 702 engages a hinged member 704 proximate to the midpoint of the hinged member 704. The lever arm 702 is sized such that when the foot pedal 604 is in the raised position, the hinged member 704 is bent. A first end 706 of the hinged member 702 is pivotally supported by a fixed-position support arm 710 attached to the frame 102. A second end 708 of the hinged member 704 is connected to a movable support arm 712 pivotally connected to the end of the fixed-position support arm 710 proximate to the frame 102. The distal end of the movable support arm 712 is carries the axle of the center-mounted wheel 700. The bending of the hinged member 704 raises the center of the wheel 700 and disengages the wheel from the ground 714.

Figure 8:
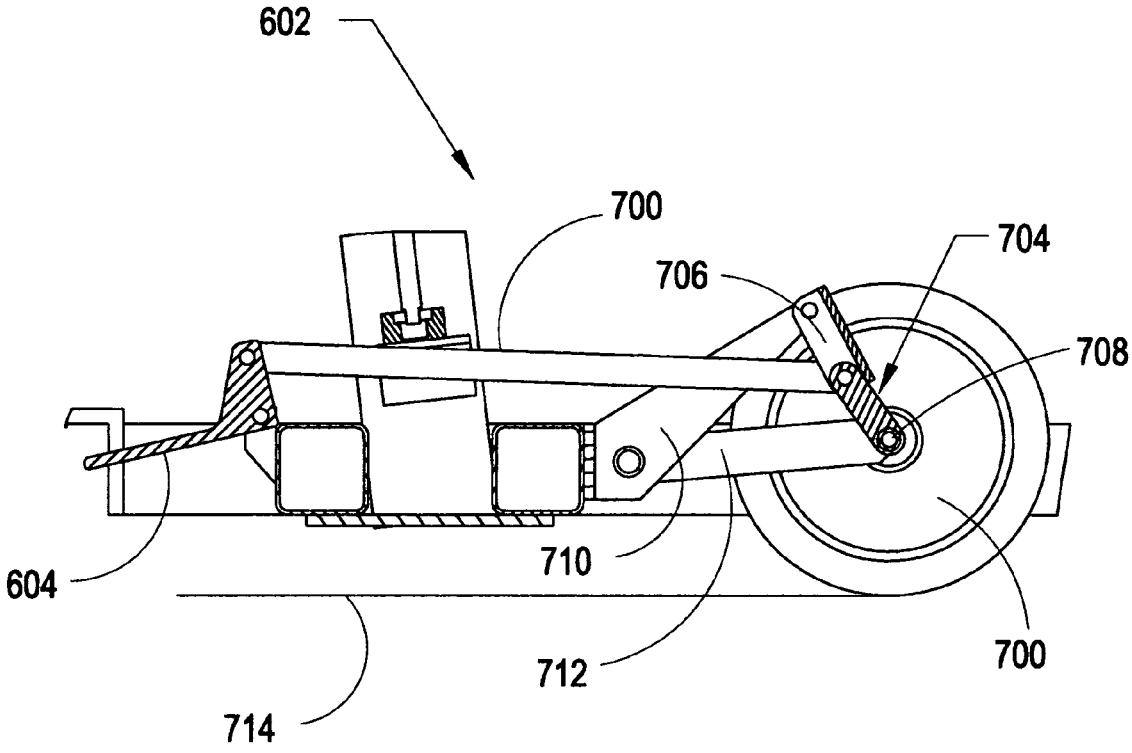
FIG. 8 is a sectional side elevation view of the center-mounted primary motion wheel system in an extended position.

FIG. 8 shows the center-mounted wheel 700 in an extended position engaging the ground 714. By depressing the foot pedal 604, the lever arm 702 exerts a force on the hinged member 704 that straightens and extends the hinged member 704. In turn, the extension of the hinged member 704 forces the movable support arm and the associated center-mounted wheel 700 to move downward and engage the ground 714. While one implementation of the retractable center-mounted wheel system 600 is shown, those skilled in the art will recognize that other retraction/engagement mechanisms can be used without departing from the scope and spirit of the present invention. Further, such retraction/engagement systems are suitable for use with both large and small diameter wheels.

Figure 9:
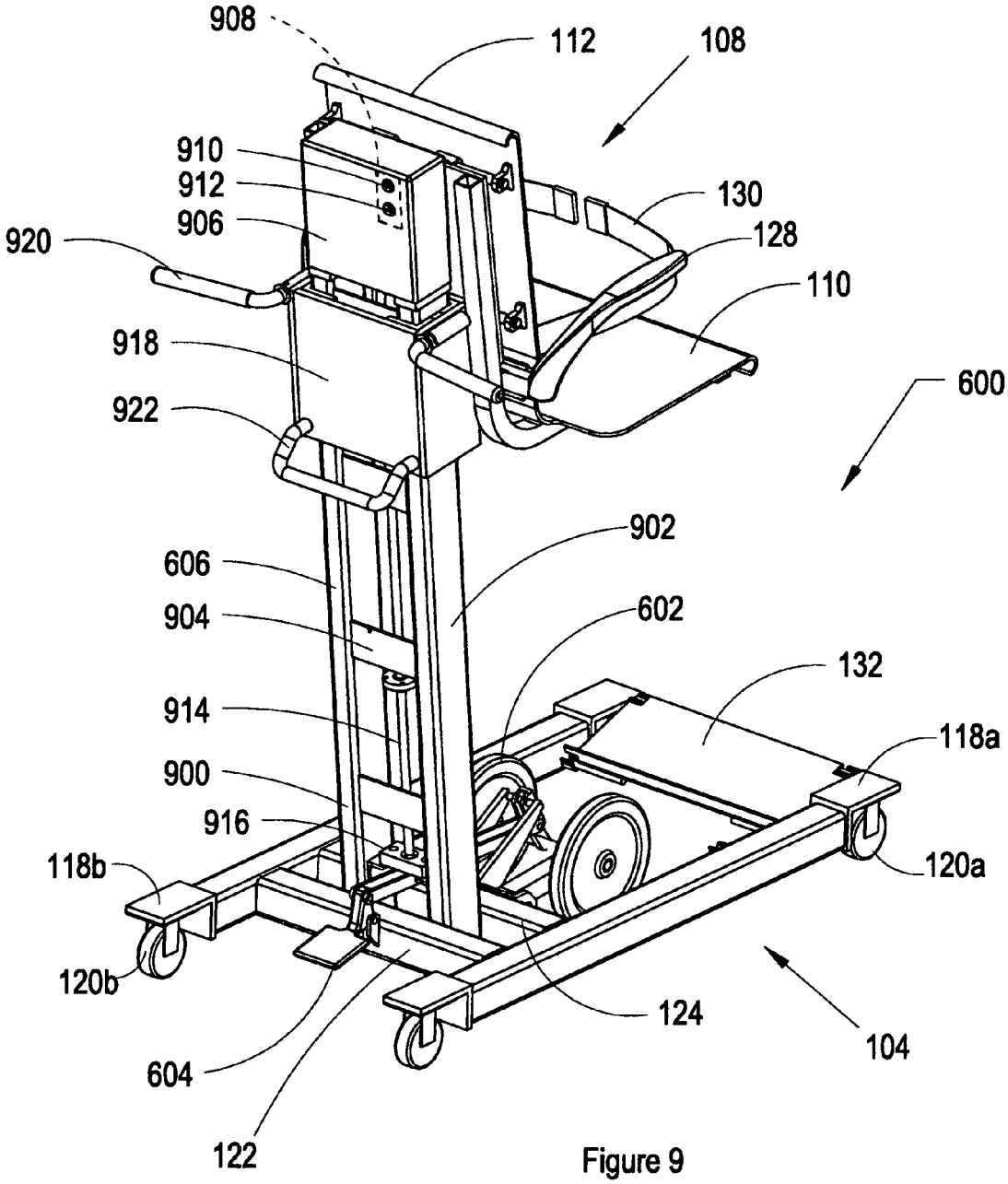
FIG. 9 is a perspective view showing the rear of an alternate embodiment of the patient transport apparatus of FIG. 6.

FIG. 9 is a rear perspective view of the patient transport apparatus shown in FIG. 6. The chair support 606 of the alternate embodiment incorporates an electronically controlled lift system instead of the manually controlled lift system of FIGS. 1 and 2. In the alternate embodiment, the chair support 606 includes a first vertical tram rail 900 and a second vertical tram rail 902. The first ends of the vertical tram rails are connected to one or more of the cross members 122, 124. In one embodiment, the vertical tram rails 900, 902 are connected to the base 104 using a permanent attachment method, such as welding. In another embodiment, the vertical tram rails 900, 902 are connected to the base 104 using a removable attachment method, such as nuts and bolts. One or more tram rail supports 904 are connected between the vertical tram rails 900, 902. In the illustrated embodiment, a plurality of tram rail supports 904 is arranged in a spaced-apart relationship leaving the rear of the chair support 606 partial open. In another embodiment, a single tram rail support panel substantially encloses the rear of the chair support 606. The tram rail supports 904 provide structural support and maintain the position of the first vertical tram rail 900 relative to the second vertical tram rail 902.

Positioned at the second end of the chair support 606 and distal from the base is a control box 906. The control box 906 encloses the drive control system, which actuates the vertical movement of the chair 108. Externally visible on the control box 906 is the user interface 908 for the drive control system. In one embodiment, the user interface 908 includes a first switch 910 and a second switch 912 that control the up and down movement of the chair 108. The embodiment of the patient transport apparatus illustrated in FIGS. 6 and 9 is designed using an electric motor located in the control box 906. A drive shaft 914 is located within the enclosure defined by the vertical tram rails 900, 902. A first end of the drive shaft 914 is operatively connected to electric motor within the control box 906. The opposing second end of the drive shaft 914 is rotatably carried by an end support 916. The end support 916 is connected to the vertical tram rails 900, 902 proximate to the lower end of the chair support 606 on either of the cross members 122, 124 or the chair support 606 itself.

The vertical tram rails 900, 902 carry a carriage 918. In the illustrated embodiment, the carriage 918 is a sleeve that overlies the exterior of the vertical tram rails 900, 902. The carriage 918 is designed to move vertically along the substantial length of the vertical tram rails 900, 902, which serve as a guide for the carriage 918. The carriage 918 engages the drive shaft 914, which imparts movement to the carriage 918. In one embodiment, the drive shaft 914 is a threaded rod that engages a threaded receptor on the carriage 918. The carriage 918 is raised or lowered depending upon the direction of rotation of the drive shaft 914. In order to facilitate the smooth movement, the carriage 918 has a low friction liner about the inner surface that contacts the chair support 606. In another embodiment, the low friction liner is replaced with bearings, rollers, or wheels.

Attached to the carriage 918 are one or more folding control handles 920. The folding control handles 920 are pivotally connected to the carriage 918 allowing the folding control handles 920 to be folded up and out of the way when the patient transport apparatus 600 needs to be brought into close proximity with an object such as an automobile. A substantially rigid material having sufficient strength to allow the patient transport apparatus 600 to be pushed or pulled using the folding control handles 920 without deformation of the folding control handles 920 is used. The opposing side placement of the folding control handles 920, in combination with the plurality of wheels 120*a*, 120*b*, allows an operator to precisely control the movement of the patient transport apparatus. The folding control handles 920 are positioned for a person of average height pushing a patient of average height positioned at a comfortable seat to footrest ratio.

In one embodiment, the patient transport apparatus 600 also includes a fixed accessory handle 922 connected to the carriage 918. The fixed accessory handle 922 provides the operator an alternate handle to use when the seat is in the upper position. Generally, the fixed accessory handle 922 is intended for extraction of the patient transport apparatus 600 from a stationary position with limited movement area. Typically, the fixed accessory handle 922 is useful to pull the patient transport apparatus 600 from a restricted space, for example when removing a patient from the passenger compartment of an automobile. Because of the more precise control, it is contemplated that the folding control handles 920 should be used to transport patient.

Figure 10:
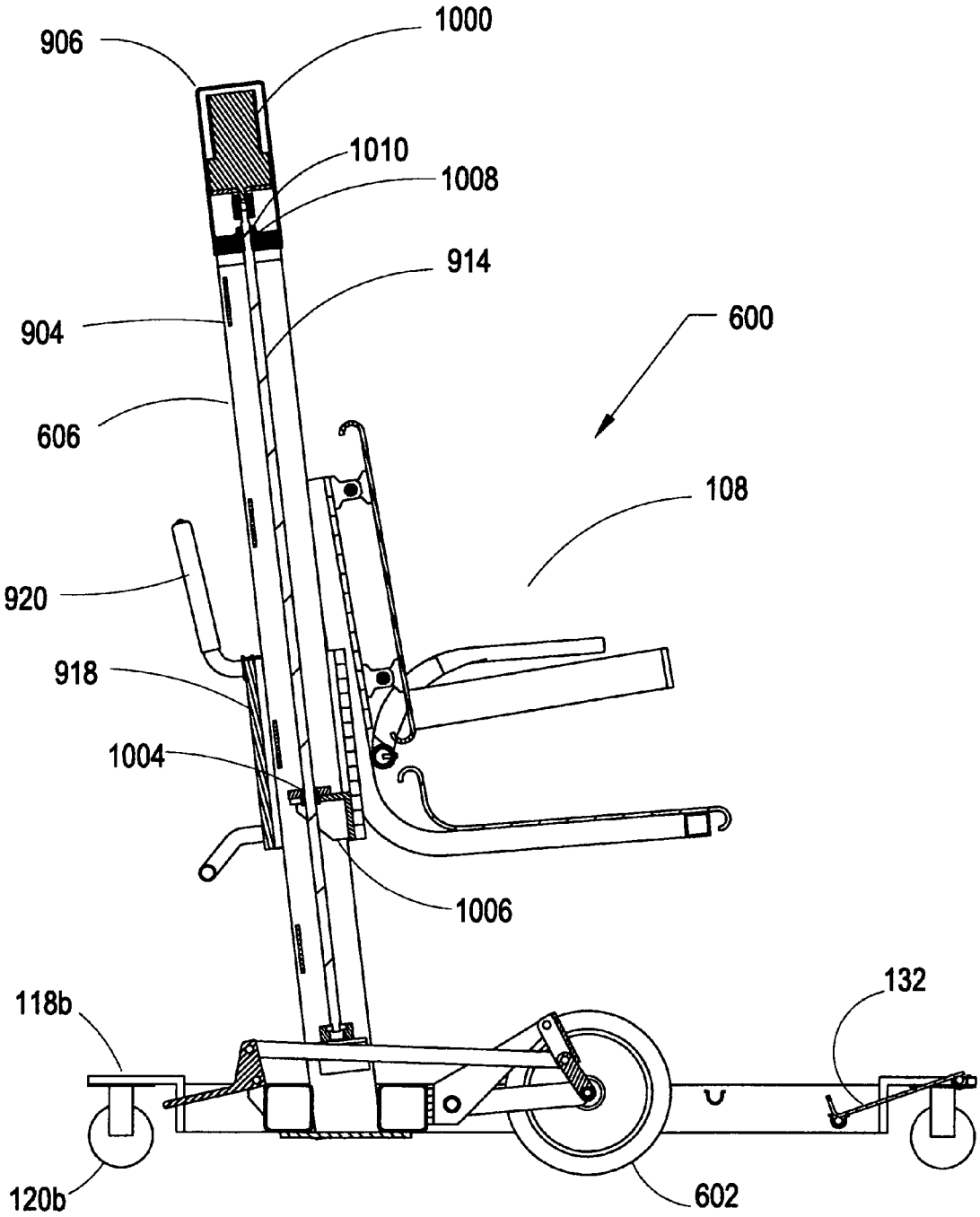
FIG. 10 is a sectional side elevation view of the electronic lift system.

FIG. 10 is a side elevation view, in section, of the patient transport apparatus 600 shown in FIGS. 6 and 9. The illustrated embodiment shows the drive motor 1000 of the lift system. The drive motor 1000 is housed in the control box 906. The drive motor engages a first end of the drive shaft 914. The opposing end of the drive shaft 914 is secured in a rod support base 1002 via a rotatable linkage. In the illustrated embodiment, the drive shaft 914 is a threaded rod or lead screw. The spacing of the threads on the lead screw 914 depends is selected based upon load bearing capacity and desire rate of travel. The lead screw 914 is received by a linear drive or lead nut 1004 that converts the rotary motion into linear motion. The lead nut 1004 is connected to the chair frame 300 by a mounting bracket 1006. A thrust bearing 1008 is mounted to a supporting member at the top of the chair support 606. The thrust bearing 1008 supports the load of the lead screw 914 while allowing rotational motion. A bearing nut 1010 attached to the lead screw 914 rests on the thrust bearing 1008 and transfers the load from lead screw 914 to the thrust bearing 1008 thereby not requiring the drive motor 1000 to support the load.

Thus far, two lift systems have been described. One is a hydraulic lift system and the other is a linear drive motor system. Those skilled in the art will appreciate that other lift systems can be used without departing from the scope and spirit of the present invention, including pneumatic systems, winch systems and other types of linear actuator systems.

The primary function of the patient transport apparatus is patient extraction and delivery. When an operator is called upon to help remove a patient from a vehicle, the patient transport apparatus is positioned between the open door and the body of the vehicle. In order to place the patient transport apparatus in seat-to-seat alignment, the first step is to raise the articulated armrest closest to the vehicle into the substantially vertical position and to slide the articulated armrest laterally toward the chair support. Next, the seat back is slid laterally away from the body of the vehicle. Then, the folding control handle closest to the vehicle is moved out of the way. It should be noted that these changes can be accomplished with one hand while in motion, without releasing any latches, within approximately five seconds.

By way of example, suggested materials and/or dimensions for various parts of the patient transport apparatus are provided. The identification of dimensions and materials is not intended to limit the disclosure but merely show one embodiment of a patient transport apparatus falling within the scope and spirit of the present invention. Those skilled in the art will recognize that the suggested materials and/or dimensions can be varied without departing from the scope and spirit of the present invention.

Figure 11:
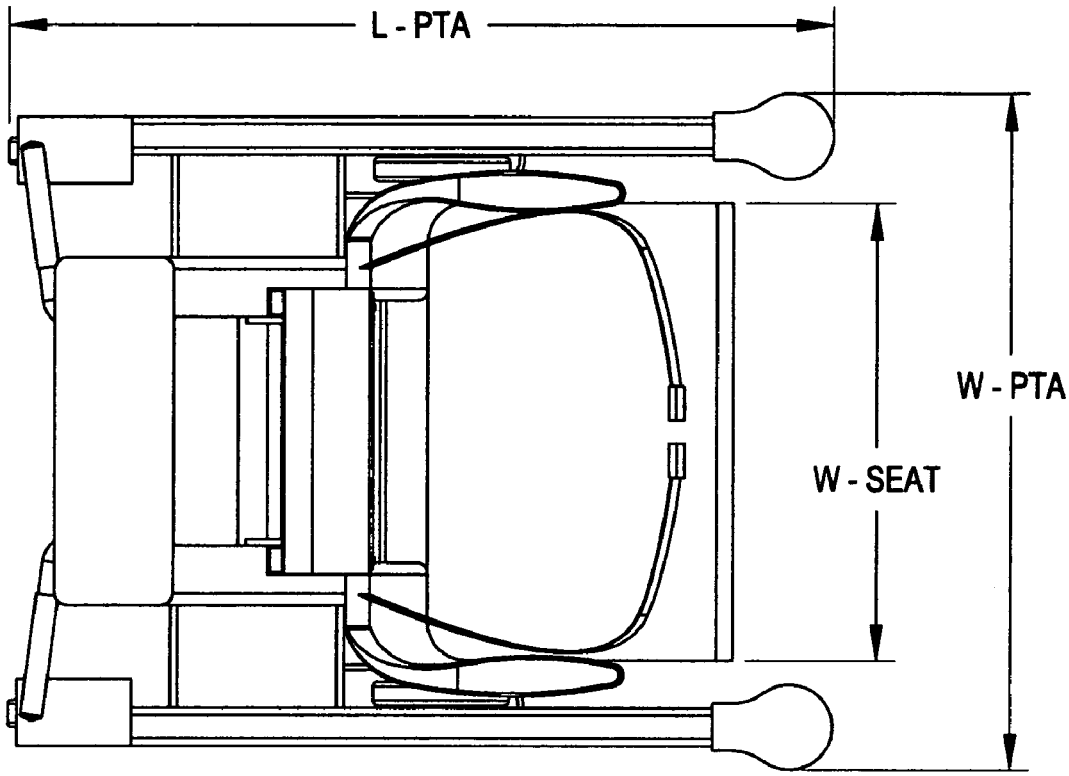
FIG. 11 is a top plan view of one embodiment of the patient transport apparatus.
Figure 12:
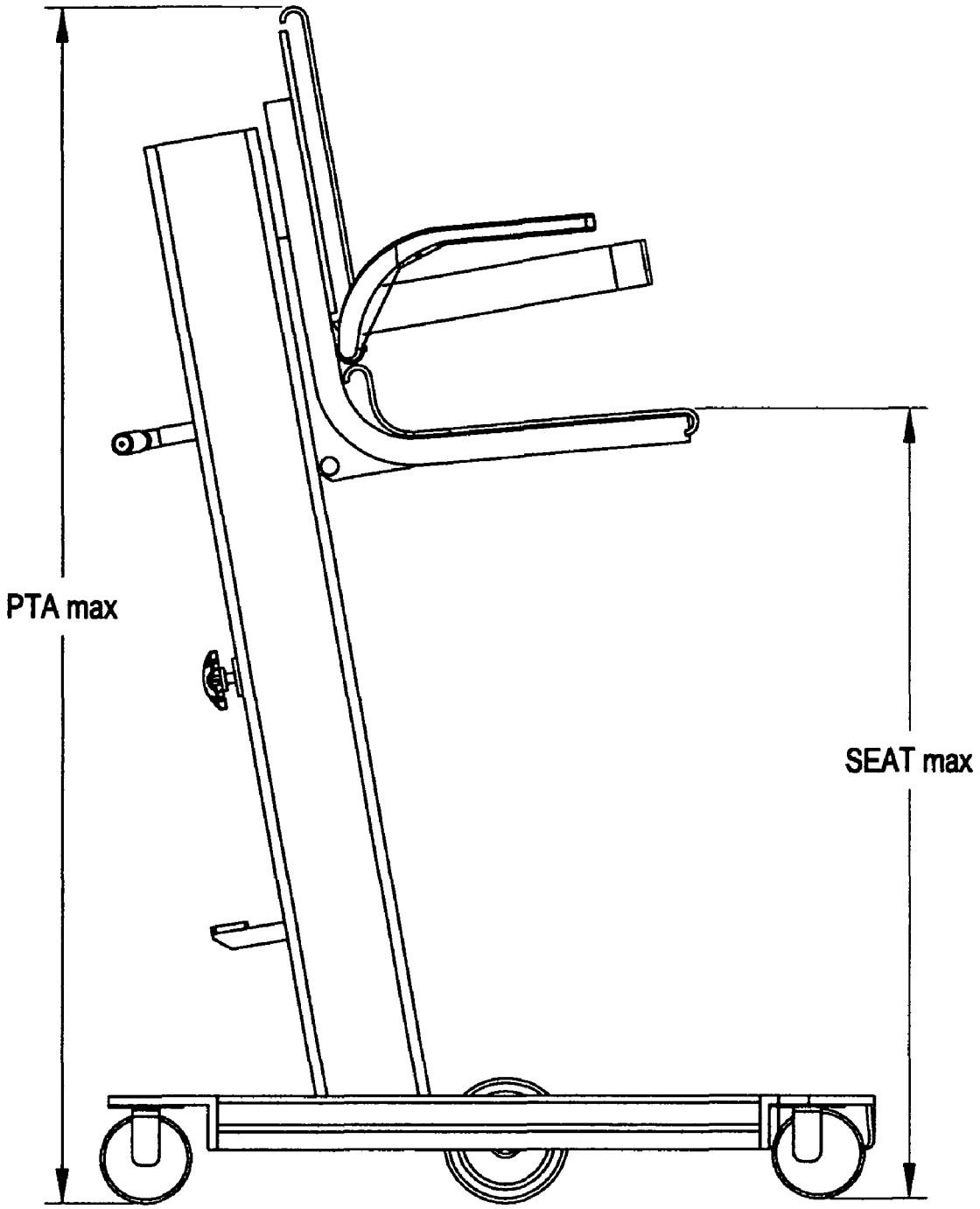
FIG. 12 is a side elevation view of one embodiment of the patient transport apparatus showing the chair in a fully raised position.
Figure 13:
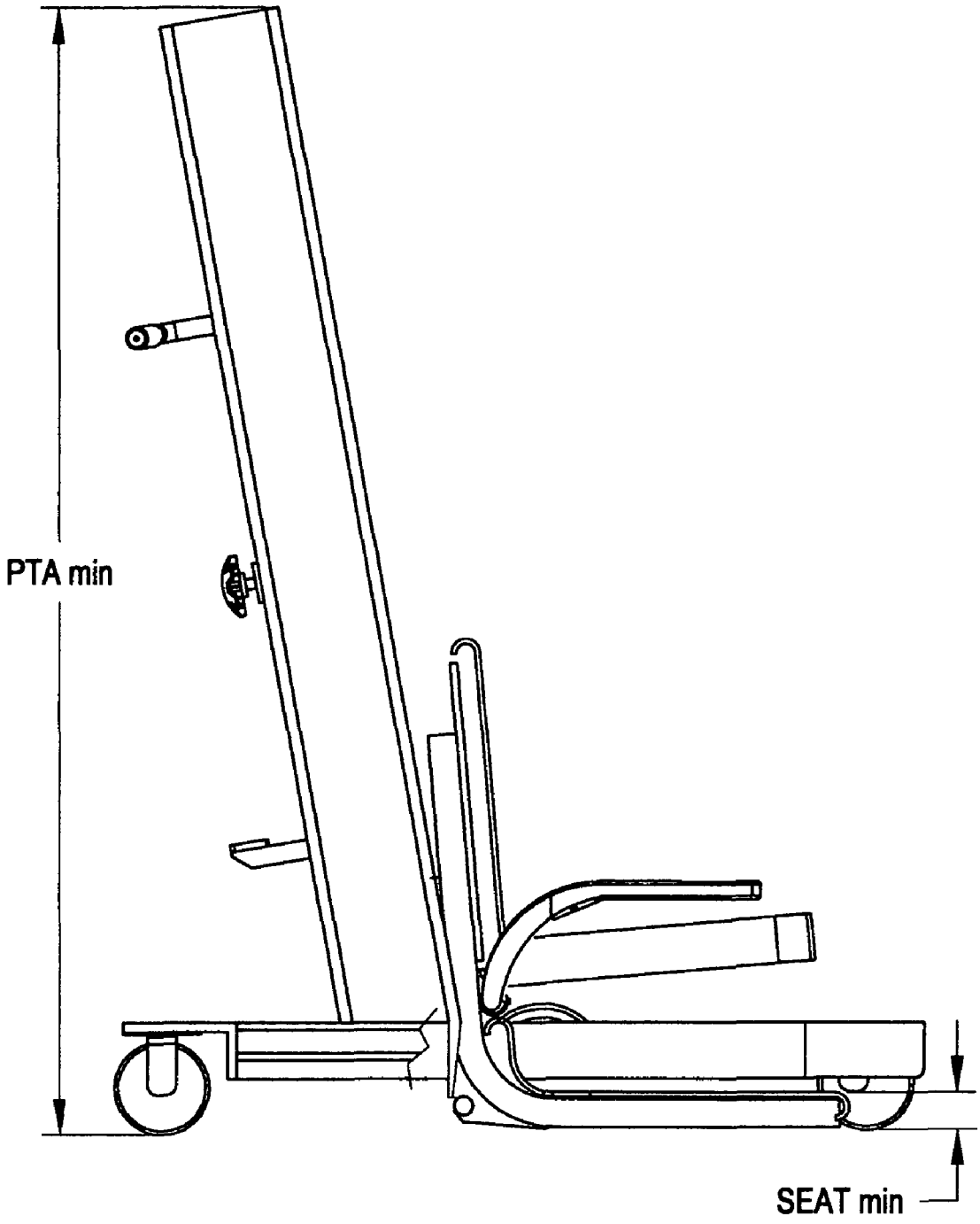
FIG. 13 is a side elevation view of one embodiment of the patient transport apparatus showing the chair in a fully raised position.

FIG. 11 is a top plan view and FIGS. 12 and 13 are side views of the patient transport apparatus 100 depicted in FIG. 1. The maximum height of the base 104, including the caster height, is selected so that the base 104 is easily maneuvered under most automobiles. One acceptable value for the maximum height that accommodates the ground clearance of most current commercially available passenger vehicles is approximately six inches. The maximum height can vary without departing from the scope and spirit of the present invention based upon the intended usage and especially in response to design changes from the automotive industry that affect the typical ground clearance values.

In one exemplary embodiment, the base is fabricated from three-inch square steel members that are welded together. The chair support is fabricated from two-inch by four-inch steel members that are welded to the base. The base has overall dimensions of approximately 36 inches in width by approximately 42 inches in length. The width is selected for stability and to allow the patient transport apparatus to pass through doorways and portals found in a healthcare facility. The length of the base is selected to provide stability. The load-bearing capacity of the patient transport apparatus is nominally 1,000 pounds. The width of the chair support is approximately 13 inches. The width of the seat is approximately 24 inches and the width of the chair back is approximately 18 inches. The side brackets and the cross members of the chair frame are fabricated from 1.5 inch square steel members to allow the seat to move as close to the floor as possible for patient recovery.

With the chair raised, as shown in FIG. 12, the maximum height of the patient transport apparatus is approximately 68 inches. With the chair lowered, as shown in FIG. 13, the minimum height of the patient transport apparatus is approximately 61 inches. The vertical movement of the chair allows the seat height be varied between a minimum of approximately 1.5 inches above the ground and a maximum height of approximately 46 inches. With the footrest removed and the chair at the minimum height, a patient can slide onto the seat from a seated position on the ground, potentially with little or no assistance.

Those skilled in the art will recognize that the connections between the various components of the patient transport apparatus can be accomplished in either permanent or temporary fashion, unless otherwise noted. As an example, one suitable permanent attachment method includes welding for metallic components. An example of a suitable removable attachment method includes the use of temporary fasteners such as nuts and bolts.

Figure 14:
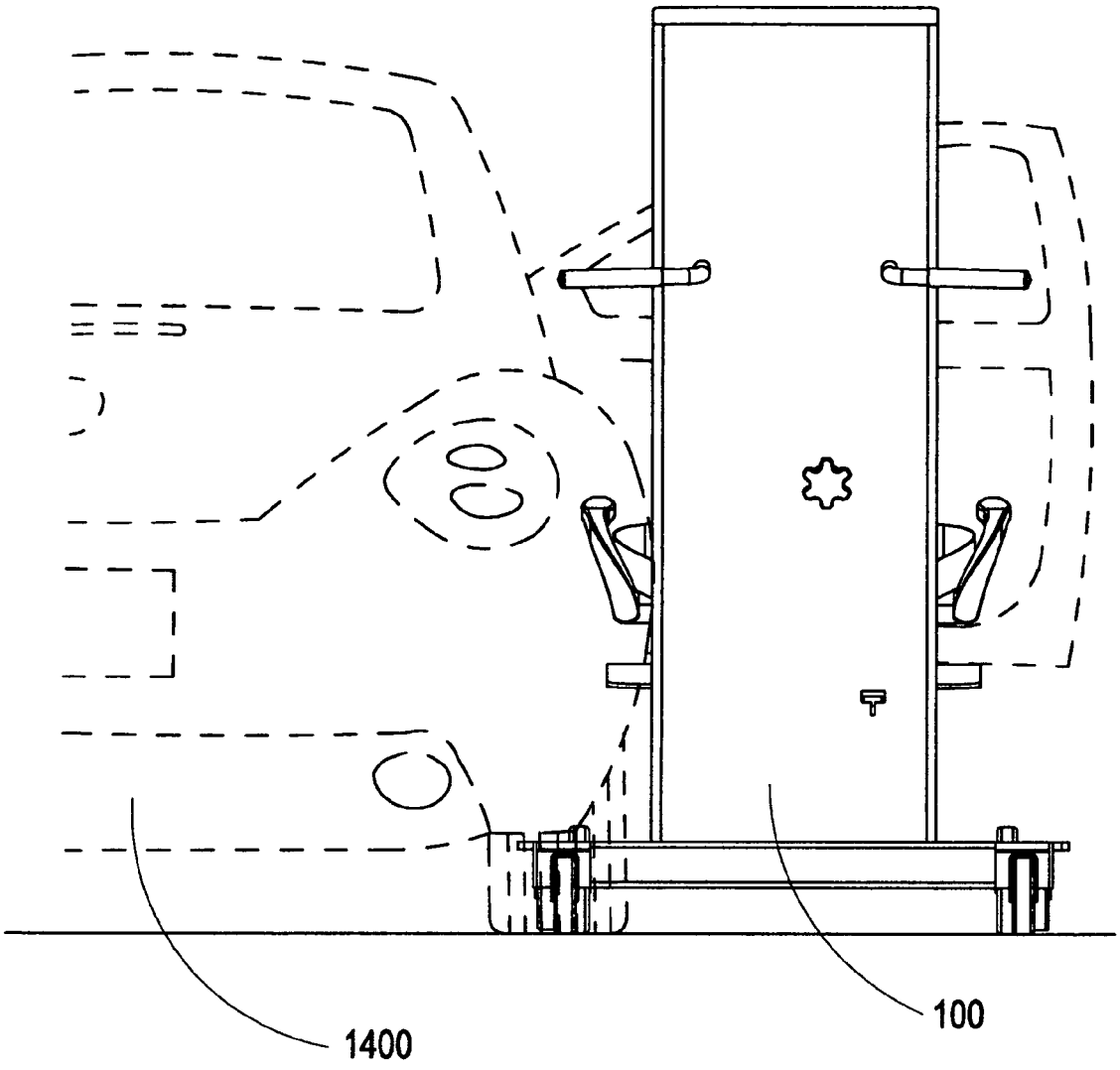
FIG. 14 illustrates the patient transport apparatus of the present invention positioned at the passenger side of a vehicle for patient extraction.

FIG. 14 illustrates the patient transport apparatus 100 of FIG. 1 positioned at the passenger side of a vehicle 1400 for patient extraction. These initial steps result in the patient transport apparatus having only two components that extend substantially beyond the chair support. The first component extending beyond the chair support is the base. As previously discussed, the base is sized to slide under the body of the vehicle and allow the patient transport apparatus to be moved very close to the vehicle. Specifically, the chair support of the patient transport apparatus is placed in a position immediately next to the body of the vehicle. The second component extending beyond the chair support is the seat. The width generally allows the seat of the patient transport apparatus to be positioned proximate to the seat of the vehicle. The height of the patient transport apparatus seat is adjusted to match the height of the vehicle seat. When properly positioned, the vehicle seat and patient transport apparatus seat lie in the same plane and any gap between the two is negligible with respect to the size of the human body. The patient transport apparatus is held in the desired position to limit movement of the patient transport apparatus while the patient is being transferred from the automobile. Examples of suitable mechanism for holding the patient transport apparatus in place include wheel chocks or wheel locks. Once properly positioned, the patient slides, with or without assistance from the operator, from the vehicle onto the patient transport apparatus. Such a transfer is not possible with presently available patient conveyances including wheelchairs, gurneys, and the cranes/lifts identified in the prior art.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A patient transport apparatus comprising:

a base comprising a first elongated member, a second elongated member, and a cross member, said first elongated member being substantially parallel to said second elongated member, said cross member connected to and extending between said first elongated member and said second elongated member;

a plurality of wheels connected to said base;

a chair support extending vertically from said base, said chair support connected to said cross member substantially midway between said first elongated member and said second elongated member;

a chair comprising a seat and a backrest, said seat adapted to fit between said first elongated member and said second elongated member, said backrest adapted to move independently of and laterally with respect to said seat, said chair having a fixed orientation relative to said chair support; and a lift system carried by said chair support, said lift system adapted to raise and lower said chair, said lift system adapted to lower said seat to the ground.

2. The patient transport apparatus of claim 1 further comprising a footrest having a first end removably secured to said base first elongated member and a second end removably secured to said base second elongated member.

3. The patient transport apparatus of claim 1 wherein each of said pair of armrests are horizontally and individually movable in a direction substantially parallel to said backrest allowing adjustment of a distance between said armrests.

4. The patient transport apparatus of claim 1 wherein each of said pair of armrests rotate about a common axis running substantially parallel to said backrest and said seat, rotation of one of said armrests allowing side entry into said chair.

5. The patient transport apparatus of claim 1 wherein said chair further comprises a mounting bracket and said lift system comprises:

a drive motor providing rotational motion;

a lead screw in operative connection with said drive motor and said mounting bracket, said lead screw having threads engaged by said mounting bracket, said lead screw converting rotational motion to linear motion to raise and lower said chair;

a thrust bearing supported by said chair support; and a bearing nut connected to said lead screw, said bearing nut transferring a load from said lead screw to said thrust bearing.

6. The patient transport apparatus of claim 1 wherein said lift system comprises:

a hydraulic cylinder operative connected to said chair;

a release mechanism for reducing pressure in said hydraulic cylinder thereby lowering said chair; and a pump mechanism for increasing pressure in said hydraulic cylinder thereby raising said chair.

7. The patient transport apparatus of claim 1 wherein first elongated member is spaced apart from said second elongated member by a distance greater than the width of said seat.

8. The patient transport apparatus of claim 7 wherein said chair lowers to height such that said seat is substantially at ground level and between said first elongated member and said second elongated member.

9. The patient transport apparatus of claim 1 wherein said plurality of wheels comprises:

a plurality of omnidirectional casters, one of said plurality of omnidirectional casters carried by each end of said first elongated member and a second elongated member; and a pair of primary motion wheels adapted for substantially linear motion, one of said pair of primary motion wheels carried by each of said first elongated member and said second elongated member, said pair of primary motion wheels being selectively engagable with the ground.

10. The patient transport apparatus of claim 1 wherein said chair further comprises a safety restraint connected to said chair to retain a patient on said seat.

11. The patient transport apparatus of claim 1 wherein said seat is substantially rigid and includes a surface having a low coefficient of friction.

12. A patient transport apparatus comprising:

a base comprising a first base side rail, a second base side rail, and a base cross member, said cross member connecting said first base side rail and said second base side rail, said base defining an inner width between said first base side rail and said second base side rail, said base having a height;

a set of wheels connected to said base and adapted to engage the ground and provide movement thereon;

a chair support connected to said cross member, said chair support being substantially orthogonal to said base, said chair support fixedly positioned substantially midway between said first base side rail and said second base side rail;

a lift mechanism carried by said chair support, said lift mechanism adapted to impart vertical motion along the substantial height of said chair support; and a chair carried by said lift mechanism, said chair comprising a frame, a seat, and a backrest, said frame being connected to said lift mechanism at a connection point, said seat being fixedly connected to said frame, said backrest adapted to move laterally with respect to said frame and independent of said seat, said seat having a lateral dimension smaller than said base inner width, said chair being adapted to be lowered into engagement with the ground.

13. The patient transport apparatus of claim 12 wherein said frame is pivotally connected to said lift mechanism, said seat defining a front portion and a rear portion, said frame adapted to pivot between a first position wherein said seat is reclined and a second position wherein said seat is substantially horizontal, said seat transitioning between said first position and said second position as said seat is being lowered into engagement with the ground, said seat transitioning from said second position to said first position as said seat is being raised from ground.

14. The patient transport apparatus of claim 12 wherein said backrest defines a side edge and said chair support defines a side edge, said backrest being moveable into a position wherein said backrest side edge is substantially flush with said chair support side edge.

15. The patient transport apparatus of claim 12 further comprising an armrest telescopically connected to said frame, said armrest adapted to move laterally with respect to said frame.

16. The patient transport apparatus of claim 12 further comprising an armrest pivotally connected to said frame, said armrest adapted to rotate between a substantially horizontal position and a substantially vertical position flush with said backrest.

17. The patient transport apparatus of claim 12 further comprising an armrest telescopically connected and pivotally connected to said frame, said armrest adapted to move laterally with respect to said frame, said armrest adapted to rotate between a substantially horizontal position and a substantially vertical position flush with said backrest.

* * * * *